US010784064B2

(12) United States Patent
Kowalyshen et al.

(10) Patent No.: US 10,784,064 B2
(45) Date of Patent: Sep. 22, 2020

(54) REDUCED SIZE FAULT INTERRUPTER

(71) Applicant: S&C Electric Company, Chicago, IL (US)

(72) Inventors: Henry Kowalyshen, Niles, IL (US); Keith Benson, Chicago, IL (US); Tsvetan Rusev, Morton Grove, IL (US)

(73) Assignee: S&C Electric Company, Chicago, IL (US)

( * ) Notice: Subject to any disclaimer, the term of this patent is extended or adjusted under 35 U.S.C. 154(b) by 0 days.

(21) Appl. No.: 16/580,412

(22) Filed: Sep. 24, 2019

(65) Prior Publication Data

US 2020/0118776 A1 Apr. 16, 2020

Related U.S. Application Data

(60) Provisional application No. 62/744,798, filed on Oct. 12, 2018.

(51) Int. Cl.
*H01H 33/66* (2006.01)
*H01H 33/662* (2006.01)
*H01H 33/666* (2006.01)

(52) U.S. Cl.
CPC ..... *H01H 33/666* (2013.01); *H01H 33/6606* (2013.01); *H01H 33/66207* (2013.01); *H01H 2207/048* (2013.01)

(58) Field of Classification Search
CPC ..... H01H 33/666; H01H 33/6606; H01H 33/66207; H01H 33/6662; H01H 9/20; H01H 31/32
USPC ..... 218/139, 134, 120, 138, 140, 141, 142, 218/118; 361/139; 307/139, 104
See application file for complete search history.

(56) References Cited

U.S. PATENT DOCUMENTS 3,292,077 A * 12/1966 Sloughter ..... G01N 27/025 324/445
3,534,304 A * 10/1970 Robinson ..... H01H 77/10 335/16
5,055,640 A * 10/1991 Lippi ..... H01H 33/666 218/120
5,912,604 A * 6/1999 Harvey ..... H01H 33/6662 218/138
6,020,567 A * 2/2000 Ishikawa ..... H01H 3/28 218/120
6,723,940 B1 * 4/2004 Book ..... H01H 33/666 218/154
7,843,293 B1 * 11/2010 Bonjean ..... H01H 3/28 218/154

(Continued)

*Primary Examiner* — William A Bolton

(57) ABSTRACT

A pole unit including a vacuum interrupter switch having a fixed contact extending into one end of a vacuum chamber and being electrically coupled to a first terminal, and a moving contact extending into an opposite end of the chamber. A sliding contact is rigidly coupled to the moving contact and slidably coupled to a second terminal. The pole unit also includes an electromagnetic actuator including a coil, a rod coupled to the sliding contact and a spring positioned against the rod. The pole unit further includes a transmitter coil and a receiver coil that are electromagnetically coupled, where the receiver coil is electrically coupled to the actuator and is electrically isolated from the transmitter coil. In this configuration, the interrupter switch, the actuator and the receiver coil are at a line potential and the transmitter coil is at ground potential.

13 Claims, 2 Drawing Sheets

(56) References Cited

U.S. PATENT DOCUMENTS

| | | | | |
|---|---|---|---|---|
| 8,941,960 | B2 * | 1/2015 | Murray | H01H 75/06 361/71 |
| 8,957,342 | B2 * | 2/2015 | McCord | H01H 33/168 218/143 |
| 2012/0274428 | A1 * | 11/2012 | Reuber | H01H 33/66207 335/6 |
| 2015/0371771 | A1 * | 12/2015 | Abu Qahouq | H04B 5/0087 307/104 |

* cited by examiner

REDUCED SIZE FAULT INTERRUPTER

BACKGROUND

Field

This disclosure relates generally to a pole unit for a switchgear and, more particularly, to a pole unit for a switchgear, where the pole unit includes a vacuum interrupter switch and an electromagnetic actuator electrically coupled together at a line potential and a pair of wireless power transfer coils for providing power to the actuator.

Discussion of the Related Art

An electrical power distribution network, often referred to as an electrical grid, typically includes a number of power generation plants each having a number of power generators, such as gas turbine engines, nuclear reactors, coal-fired generators, hydro-electric dams, etc. The power plants provide a high voltage AC signal on high voltage transmission lines that deliver electrical power to a number of substations typically located within a community, where the voltage is stepped down to a medium voltage. The substations provide the medium voltage power to a number of three-phase feeder lines. The feeder lines are coupled to a number of lateral lines that provide the medium voltage to various transformers, where the voltage is stepped down to a low voltage and is provided to a number of loads, such as homes, businesses, etc.

Power distribution networks of the type referred to above typically include a number of switching devices, breakers, reclosers, interrupters, etc. that control the flow of power throughout the network. Some of these components are enclosed in a number of external housings that are mounted on, for example, a concrete pad, mounted underground or overhead, and are generally referred to herein as switchgear. The number and type of switchgear are application specific to the particular power network.

A typically switchgear includes a number of pole units, for example, three pole units for a three-phase network. Each pole unit is an assembly of components that include a fault interrupter switch including opposing contacts for disconnecting the power line, an electromagnetic actuator for actuating the switch, energy storage elements, control electronics, etc. Usually the fault interrupter switch is a vacuum interrupter switch that employs opposing contacts, one fixed and one movable, positioned within a vacuum enclosure. When the interrupter switch is opened by moving the movable contact away from the fixed contact the arc that is created between the contacts is quickly extinguished by the vacuum. A vapor shield is provided around the contacts to contain the arcing. For certain applications, the vacuum interrupter switch is encapsulated in a solid insulation housing that has a grounded external surface.

Workman are often restricted during the installation of switchgear by access, real estate, size and weight of the components. For example, space is a premium in underground vaults that have other equipment and small hatches. Pad-mounted switchgear use ground-level real estate that often requires lease payments based on area. Overhead installations often have limited truck/crane access, and thus the easier the switchgear is to maneuver the more pole-top sites become available. Thus, there is an effort in the industry to reduce the size of the switchgear. Further, by reducing the size and part count in a pole unit, mechanical performance may be more robust and handling becomes easier.

Modern fault interrupters employ solid state dielectrics where the interrupter is encapsulated in an epoxy. In known switchgear designs, especially for three-phase switchgear, the actuator that opens the switch is electrically isolated from the switch, where the interrupter switch is generally at the medium voltage line potential and the actuator is at ground potential so that it can interface with the electronics, which are also at ground potential. This electrical isolation requires a significant air gap between the switch and the actuator that can be on the order of 5-10 inches for medium voltage power levels. If this air gap can be eliminated, then the size and weight of the pole unit can be reduced.

SUMMARY

The following discussion discloses and describes a pole unit applicable to be part of a switchgear. The pole unit includes an outer housing and a first terminal and a second terminal extending into the housing. The pole unit also includes a vacuum interrupter switch having a vacuum chamber, a fixed contact extending into one end of the vacuum chamber and being electrically coupled to the first terminal, and a moving contact extending into an opposite end of the chamber. A sliding contact is rigidly coupled to the moving contact and slidably coupled to the second terminal, but could be rigidly coupled to the second terminal in a different design. The pole unit also includes an electromagnetic actuator having a coil wound on an annular or rectangular member, a rod extending into the member and being coupled to the sliding contact and a spring positioned against the rod and applying a spring bias, where actuation of the actuator forces the moving contact against the fixed contact to make an electrical connection therebetween, and where the annular member is electrically coupled to the second terminal. The pole unit further includes a power assembly having a transmitter coil and a receiver coil that are electromagnetically coupled, where the receiver coil is electrically isolated from the transmitter coil. In this configuration, the interrupter switch, the actuator and the receiver coil are at line potential and the transmitter coil is at ground potential.

Additional features of the disclosure will become apparent from the following description and appended claims, taken in conjunction with the accompanying drawings.

DETAILED DESCRIPTION OF THE EMBODIMENTS

The following discussion of the embodiments of the disclosure directed to a pole unit for a switchgear, where the pole unit includes a vacuum interrupter switch and an electromagnetic actuator electrically coupled together at line potential and a pair of wireless power transfer coils for providing power to the actuator, is merely exemplary in nature, and is in no way intended to limit the invention or its applications or uses. For example, as mentioned, the pole unit has particular application for use in medium voltage switchgear. However, as will be appreciated by those skilled in the art, the pole unit may have other applications.

Figure 1:
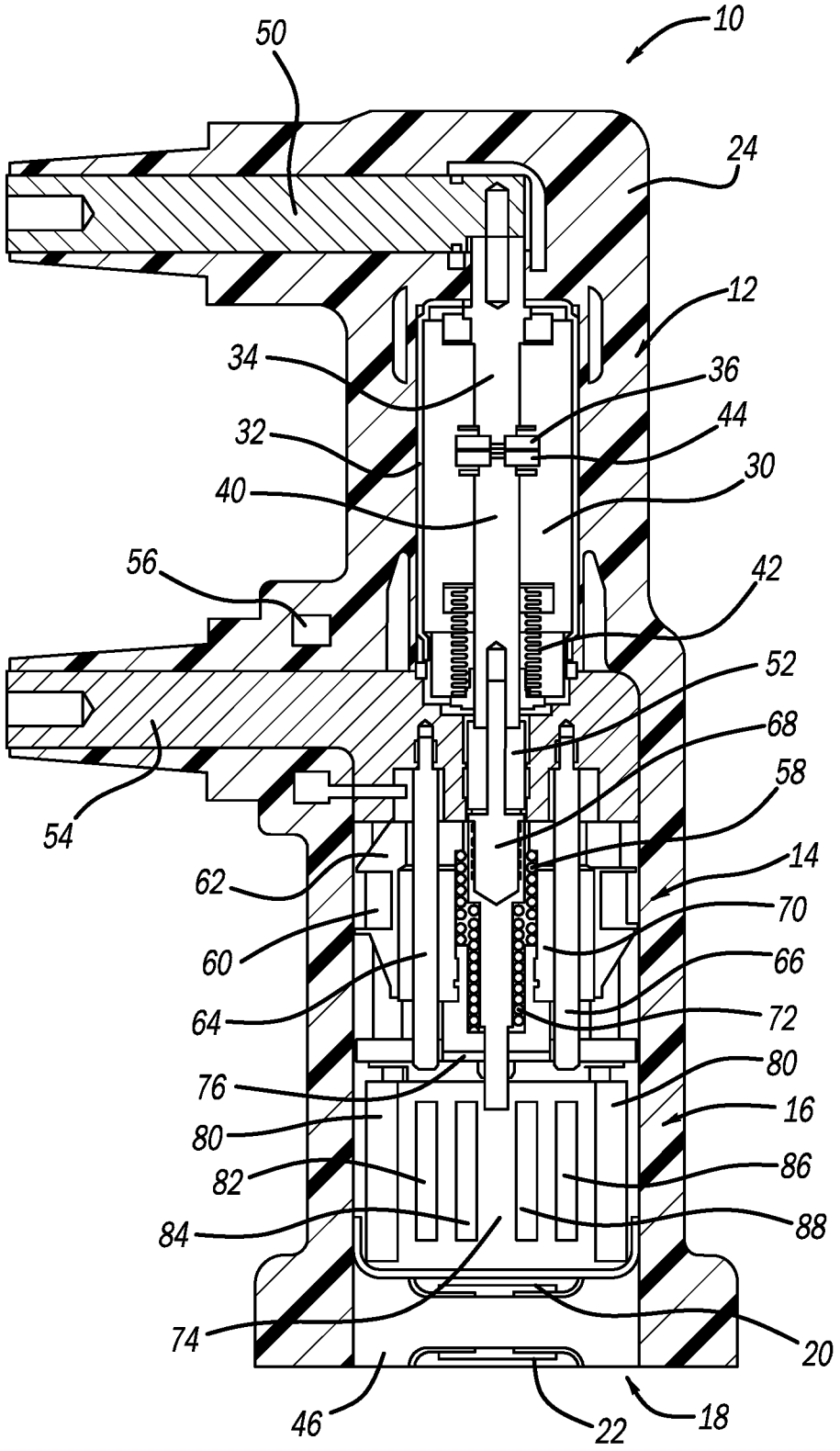
FIG. 1 is a cross-sectional type view of an inside pole unit including a vacuum interrupter switch, an electromagnetic actuator and energy storage elements all at line potential.

FIG. 1 is a cross-sectional view of a pole unit 10 that has application for use in, for example, pad-mounted switchgear, underground switchgear, metal-enclosed switchgear, metal-clad switchgear, air insulated ring main units, wind turbine switchgear, etc. The pole unit 10 generally includes from top to bottom a vacuum interrupter switch 12, an electromagnetic actuator 14, an electronics assembly 16 and a wireless power assembly 18 including a receiver coil 20 and a transmitter coil 22 all configured within an outer housing 24. As will be discussed in detail below, the interrupter switch 12, the actuator 14, the electronics assembly 16 and the receiver coil 20 are all at line potential and the transmitter coil 22 is at ground potential. By configuring the pole unit 10 in the manner shown and described, the air gap normally necessary to electrically isolate the interrupter switch 12 from the actuator 14 in traditional pole units because the switch 12 is at line potential and the actuator is at ground potential can be eliminated, thus reducing the size of the unit 10.

The vacuum interrupter switch 12 includes a cylindrical vacuum chamber 30 defined by an insulating enclosure 32. The vacuum interrupter switch 12 further includes a fixed contact 34 extending through a top end of the chamber 30 and having an annular contact portion 36 positioned within the chamber 30 and a moving contact 40 extending through a bellows 42 into the chamber 30 and having an annular contact portion 44 positioned within the chamber 30, where the bellows 42 maintains the vacuum within the chamber 30 when the contact 40 moves. The fixed contact 34 is electrically coupled to an upper unit terminal 50 and the moving contact 40 is electrically and rigidly coupled to a sliding contact 52 that is electrically and slidably coupled to a lower unit terminal 54, where the terminals 50 and 54 extend out of the housing 24 to be connected to the power line (not shown). When the electromagnetic actuator 14 is actuated and the switch 12 is closed, the contact portions 36 and 44 are held in contact with each other, discussed in further detail below, and when the switch 12 is opened under spring bias, the contact portion 44 is moved away from the contact portion 36 to define a gap therebetween. A Rogowski coil 56 known to those skilled in the art encircles the lower terminal 54 and measures the current flow therethrough.

The actuator 14 includes a coil 60 wound on an annular or rectangular member 62 that is rigidly mounted to the terminal 54 by rods 64 and 66 and secured thereto by bolts (not shown). The actuator 14 further includes a slidable rod 68 slidably mounted within a sleeve 70 and being concentrically positioned within the member 62, where the rod 68 extends through and is rigidly coupled to the sliding contact 52 and is mounted to the contact 40. When the coil 60 is energized, the rod 68 moves upward against the bias of a spring 58 and with the assist of a spring 72 to move the contact portion 44 against the contact portion 36 to close the switch 12. When the coil 60 is de-energized, the spring 58 assists to open the switch 12, and permanent magnet forces hold the rod 68 in place.

Because the actuator 14 is at line potential it needs to be electrically isolated from ground potential, but still needs to be energized from a power source at ground potential. This electrical connection is provided through magnetic coupling between the coils 20 and 22 that are electrically separated, where the coil 20 is at line potential and the coil 22 is at ground potential. The coils 20 and 22 are potted within a potting material 46 to provide the electrical isolation therebetween and be rigidly held within the housing 24.

The electronics assembly 16 is configured in a chamber 74 between the electromagnetic actuator 14 and the power assembly 18, where the assembly 16 is separated from the actuator 14 by a plate 76. The assembly 16 includes an energy storage unit 80, such as a capacitor, super-capacitor, battery, etc., an actuator coil drive circuit 82, a power receiver coil harvesting circuit 84, a Rogowski coil measurement acquisition circuit 86 and a communications circuit 88. The receiver coil 20 is connected to the power receiver coil harvesting circuit 84, the harvesting circuit 84 is connected to the actuator drive circuit 82 and the drive circuit 82 is connected to the actuator coil 60 through a suitable switching network (not shown). The acquisition circuit 86 receives the current measurement signals from the Rogowski coil 56. The communications circuit 88 provides signals to and receives signals from a main switchgear controller (not shown) such as through optical signaling, for example, infrared, across the potting material 46.

Figure 2:
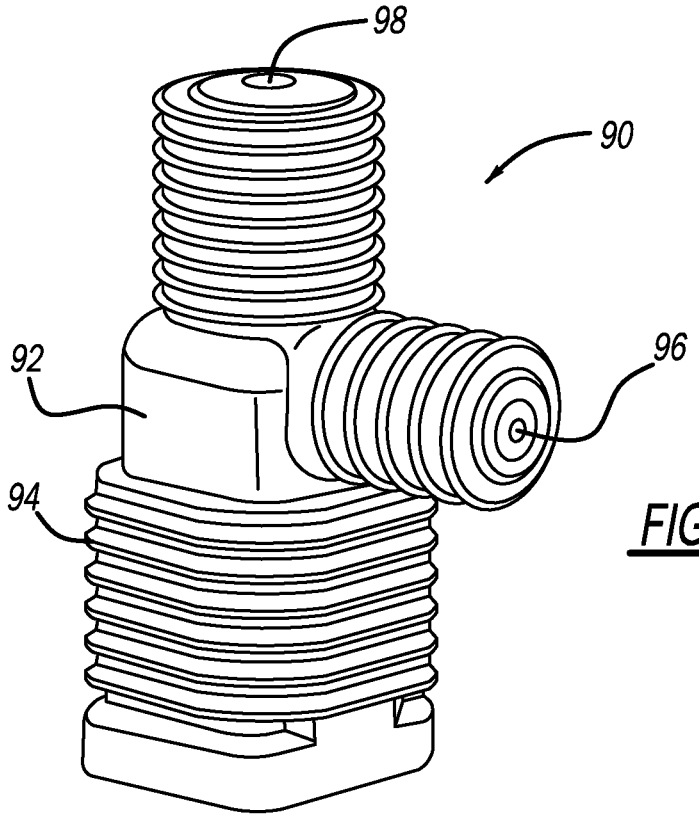
FIG. 2 is an isometric view of an outside pole unit including a vacuum interrupter switch, an electromagnetic actuator and energy storage elements all at line potential.
Figure 3:
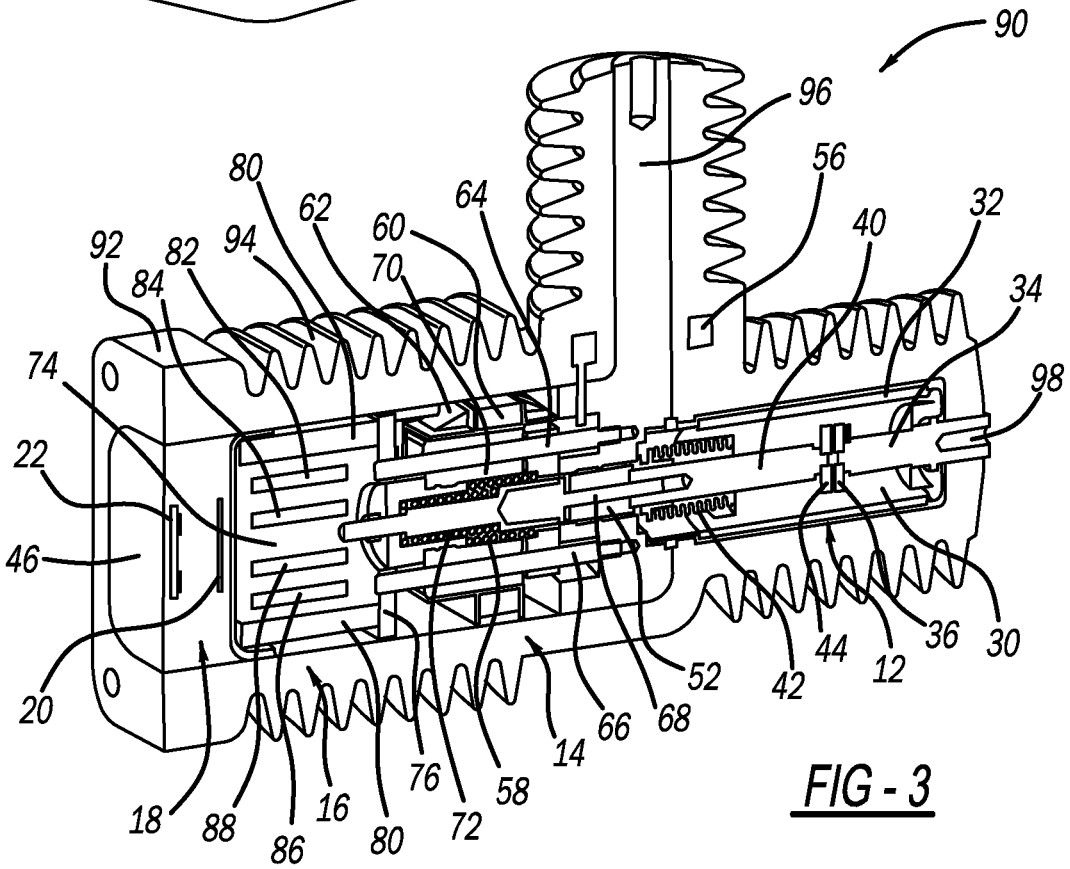
FIG. 3 is a cross-sectional type view of the pole unit shown in FIG. 2.

The pole unit 10 has a particular shape and may have application to be used for enclosed switchgear for inside use. Other designs may be more applicable for outside uses. FIG. 2 is an isometric view and FIG. 3 is a cross-sectional view of a pole unit 90 that may have such a use. In this design, the pole unit 90 includes an outer housing 92 having current sheds 94, where one terminal 96 extends into a side of the housing 92 and another terminal 98 extends through a top of the housing 92. FIG. 3 shows the vacuum interrupter switch 12, the actuator 14, the electronics assembly 16 and the wireless power assembly 18 positioned within the housing 92 and being configured in the same manner as described above as shown by the same reference numbers.

The foregoing discussion discloses and describes merely exemplary embodiments of the present disclosure. One skilled in the art will readily recognize from such discussion and from the accompanying drawings and claims that various changes, modifications and variations can be made therein without departing from the spirit and scope of the disclosure as defined in the following claims.

What is claimed is:

1. A pole unit comprising:

an outer housing;

a first terminal and a second terminal extending into the housing;

a vacuum interrupter switch including a vacuum chamber, a fixed contact extending into one end of the vacuum chamber and being electrically coupled to the first terminal, and a moving contact extending into an opposite end of the chamber;

a sliding contact rigidly coupled to the moving contact and slidably coupled to the second terminal;

an electromagnetic actuator including a coil wound on a member, a rod extending into the member and being coupled to the sliding contact and a spring positioned against the rod, the member being electrically coupled to the second terminal; and a power assembly including a transmitter coil and a receiver coil that are electromagnetically coupled, the receiver coil being electrically coupled to the actuator and being electrically isolated from the transmitter coil, wherein the interrupter switch, the actuator and the receiver coil are at a line potential and the transmitter coil is at ground potential.

2. The pole unit according to claim 1 wherein an optical communications circuit transmits optical information signals across a potting material.

3. The pole unit according to claim 1 further comprising an electronics assembly positioned within a chamber between the electromagnetic actuator and the power assembly.

4. The pole unit according to claim 3 wherein the electronics assembly includes an energy storage unit, an actuator coil drive circuit, a power receiver coil harvesting circuit, a coil measurement acquisition circuit, and a communications circuit.

5. A pole unit for a switchgear comprising:

an outer housing;

a first terminal and a second terminal extending into the housing;

a vacuum interrupter switch including a vacuum chamber, a fixed contact extending into one end of the vacuum chamber and being electrically coupled to the first terminal, and a moving contact extending into an opposite end of the chamber;

a sliding contact rigidly coupled to the moving contact and slidably coupled to the second terminal;

an electromagnetic actuator including a coil wound on a member, a rod extending into the member and being coupled to the sliding contact and a spring positioned against the rod, the member being electrically coupled to the second terminal; and a power assembly including a transmitter coil and a receiver coil that are electromagnetically coupled, the receiver coil being electrically coupled to the actuator and being electrically isolated from the transmitter coil, wherein the transmitter coil and the receiver coil are embedded in an electrically isolating potting material, and wherein the interrupter switch, the actuator and the receiver coil are at a line potential and the transmitter coil is at ground potential.

6. The pole unit according to claim 5 wherein the member is bolted to the second terminal.

7. The pole unit according to claim 5 wherein the first and second terminals extend through side ports in the housing.

8. The pole unit according to claim 5 wherein the first terminal extends out of a top port in the housing and the second terminal extends out of a side port in the housing.

9. The pole unit according to claim 5 further comprising an electronics assembly positioned within a chamber between the electromagnetic actuator and the power assembly.

10. The pole unit according to claim 9 wherein the electronics assembly includes an energy storage unit, an actuator coil drive circuit, a power receiver coil harvesting circuit, a coil measurement acquisition circuit, and a communications circuit.

11. The pole unit according to claim 5 further comprising a Rogowski coil encircling the second terminal and measuring current therethrough.

12. The pole unit according to claim 5 further comprising an optical communications circuit for transmitting optical information signals across the potting material.

13. A pole unit for a switchgear comprising:

an outer housing;

a first terminal and a second terminal extending into the housing;

a vacuum interrupter switch including a vacuum chamber, a fixed contact extending into one end of the vacuum chamber and being electrically coupled to the first terminal, and a moving contact extending into an opposite end of the chamber;

a sliding contact rigidly coupled to the moving contact and slidably coupled to the second terminal;

an electromagnetic actuator including a coil wound on a member, a rod extending into the member and being coupled to the sliding contact and a spring positioned against the rod and applying a spring bias that forces the moving contact away from the fixed contact to disconnect an electrical connection therebetween, the member being electrically coupled to the second terminal;

a power assembly including a transmitter coil and a receiver coil that are electromagnetically coupled, the receiver coil being electrically coupled to the actuator and being electrically isolated from the transmitter coil, wherein the transmitter coil and the receiver coil are embedded in an electrically isolating potting material; and an electronics assembly positioned within a chamber between the electromagnetic actuator and the power assembly, wherein the electronics assembly includes an energy storage unit, an actuator coil drive circuit, a power receiver coil harvesting circuit, a coil measurement acquisition circuit, and a communications circuit, and wherein the interrupter switch, the actuator and the receiver coil are at a line potential and the transmitter coil is at ground potential.

* * * * *